US008199019B2

(12) United States Patent
Kaczmarz et al.

(10) Patent No.: US 8,199,019 B2
(45) Date of Patent: Jun. 12, 2012

(54) FIELD RETROFITTABLE REFRIGERATOR LOCK WITH TEMPERATURE MONITORING, TEMPERATURE BASED ACCESS CONTROL AND ALARMING

(75) Inventors: Kenneth A. Kaczmarz, LaGrange Park, IL (US); Mitchell S. Mlynarczyk, Hoffman Estates, IL (US); John Payson, Bolingbrook, IL (US); Brock Robinson, Crest Hill, IL (US); Ernest Vaughn, Waukegan, IL (US); Francis H. Zimmerman, Libertyville, IL (US); Matthew R. Greiner, Simpsonville, SC (US)

(73) Assignee: CompX International Inc., Greenville, SC (US)

( * ) Notice: Subject to any disclaimer, the term of this patent is extended or adjusted under 35 U.S.C. 154(b) by 880 days.

(21) Appl. No.: 12/271,206

(22) Filed: Nov. 14, 2008

(65) Prior Publication Data

US 2009/0132090 A1 May 21, 2009

Related U.S. Application Data

(60) Provisional application No. 60/988,903, filed on Nov. 19, 2007.

(51) Int. Cl.
*G08B 21/00* (2006.01)

(52) U.S. Cl. ..... 340/585; 340/5.73; 62/129

(58) Field of Classification Search ..... 340/5.7, 340/5.73, 5.81, 6.1, 540, 585; 62/125–129; 700/275, 278, 299; 702/130; 70/278.1
See application file for complete search history.

(56) References Cited

U.S. PATENT DOCUMENTS

| | | | | |
|---|---|---|---|---|
| 5,617,082 | A | 4/1997 | Denison et al. | |
| 6,359,547 | B1 | 3/2002 | Denison et al. | |
| 7,456,725 | B2 | 11/2008 | Denison et al. | |
| 7,482,907 | B2 | 1/2009 | Denison et al. | |
| 7,683,758 | B2 | 3/2010 | Denison et al. | |
| 7,741,952 | B2 | 6/2010 | Denison et al. | |
| 2007/0257773 | A1 * | 11/2007 | Hill et al. | 340/5.73 |
| 2009/0231132 | A1 * | 9/2009 | Shoenfeld | 340/542 |

* cited by examiner

*Primary Examiner* — Jeffery Hofsass
(74) *Attorney, Agent, or Firm* — Dority & Manning, P.A.

(57) ABSTRACT

Disclosed are apparatus and methodology subject matters for temperature monitoring and controlled access to refrigerated medications. An electronically controlled lock is installed on a refrigerator used for storage of temperature sensitive medications. Lock access is given to individuals having differing levels of access authorization so that user level authorization holders may have access to stored medications. Supervisor level authorization holders may have access to stored medications and may also effect changes in lock settings including setting alarm levels. Alarm levels may be adjusted to monitor temperatures within the refrigerated storage area so that in the case that temperature fall outside preset limits, access to the stored medicines may be had only by those individuals having supervisory access authorization.

19 Claims, 13 Drawing Sheets

FIELD RETROFITTABLE REFRIGERATOR LOCK WITH TEMPERATURE MONITORING, TEMPERATURE BASED ACCESS CONTROL AND ALARMING

PRIORITY CLAIM

This application claims the benefit of previously filed U.S. Provisional Patent Application entitled "FIELD RETROFITTABLE REFRIGERATOR LOCK WITH TEMPERATURE MONITORING, TEMPERATURE BASED ACCESS CONTROL AND ALARMING," assigned U.S. Ser. No. 60/988,903, filed Nov. 19, 2007, and which is incorporated herein by reference for all purposes.

FIELD OF THE INVENTION

The present subject matter is directed toward secured storage refrigeration. More particularly, the present subject matter is directed to the secure storage and tracking of refrigerated, temperature sensitive medications, narcotics, vaccines and chemicals.

BACKGROUND OF THE INVENTION

In a typical application, various temperature sensitive refrigerated medications, narcotics, vaccines and chemicals (hereafter collectively referred to as medications) are stored in small refrigerators at nurses' stations in a hospital. Small refrigerators are not typically designed for security and are therefore not generally provided with any type of locking mechanism. New requirements set forth by the Joint Commission on Accreditation of Healthcare Organizations (JCAHO) as well as the ever-increasing needs for security are dictating the need to secure and track temperature sensitive medications, particularly narcotics.

As is known in the medical profession, certain medications may be temperature sensitive and may be rendered unfit for use if not maintained within a given temperature range. Under such conditions, therefore, a need exists not only to secure these medications but to also continuously monitor the temperature at which they are stored. There are a number of reasons that can cause temperature variations to occur. These reasons include, but are not limited to: power failure, refrigerator malfunction, or improper securing of the refrigerator door after access. Given the severe consequences, such as a medication becoming ineffective or dangerous after such an event, it is essential that any responsible party (such as, including nurses, doctors, and others) be made aware of any such event. Additionally, if such an event does occur, they may become a need or a desire to provide alarm functionality and/or restricted access to potentially unsafe medications.

As different medications have various recommended temperature ranges and associated tolerances for storage outside such ranges, the need exists for temperature monitoring and access control system functionality that may be fully programmable. Programmable adjustments which may be desired may include: settings of respective high and low temperature limits, settings of the permitted time period outside of such desired limits, settings of various alarms, and the setting of restricted access if certain limits are reached. For example, if a certain pre-programmed event were to occur, a refrigerator typically accessed by general users may become restricted to management level personnel only. The present temperature monitoring and access control system functionality would therefore have the potential to prevent the use of dangerous or ineffective medications.

While various implementations of secured refrigeration systems have been developed, and while various temperature responsive systems have been developed, no design has emerged that generally encompasses all of the desired characteristics as hereafter presented in accordance with the subject technology.

SUMMARY OF THE INVENTION

In view of the recognized features encountered in the prior art and addressed by the present subject matter, improved apparatus and methodology subject matters for controlling access to refrigerated storage areas have been developed.

In an exemplary configuration, a retrofittable motorized latch and an electronic access control circuit for use with small refrigeration systems have been provided.

In one of its simpler forms, a user interface and display is provided to permit convenient adjustment of system operational parameters.

Another positive aspect of the disclosed type of device is that operational parameters for the disclosed apparatus may be adjusted by way of a computer interface and accompanying software operating on, for example, a personal computer.

In accordance with aspects of certain embodiments of the present subject matter, methodologies are provided, upon occurrence of operational conditions potentially detrimental to materials stored within the refrigerated storage space, to limit access to refrigerated storage space to only those individuals with supervisory access authorization.

In accordance with certain aspects of other embodiments of the present subject matter, methodologies have been developed to track access to a refrigerated storage space by recording user identification and access dates and times.

In accordance with yet additional aspects of further embodiments of the present subject matter, apparatuses and accompanying methodologies have been developed to record operating parameters of the refrigeration system.

According to yet still other aspects of additional embodiments of the present subject matter, apparatuses and methodologies have been developed to insure that access to the refrigerated storage space is denied even to authorized users in case of faulty operation of the refrigeration system.

One present exemplary apparatus relates to a refrigerated area access control system, comprising an access control circuit, a lock, a user interface, and a temperature transducer. Such lock is preferably configured to be unlocked by the access control circuit. Such user interface may be configured to provide user access to such access control circuit, which such temperature transducer may be coupled to such access control circuit and configured for placement within the refrigerated area.

With the foregoing exemplary embodiment, preferably such access control circuit may be configured to monitor the temperature within the refrigerated area and to respectively permit differentiated access to the refrigerated area by a first user having a first access level and a second user having a second access level. With such an arrangement, the first user is denied access to the refrigerated area when the temperature within the refrigerated area is not maintained within predetermined parameters.

In certain optional implementations of the foregoing embodiment, such user interface may be further configured to permit such second user to adjust system operational parameters comprising one or more of adding credentials for first users, deleting credentials for first users, and adjusting temperature based parameter settings.

With still further options, such a refrigerated area access control system may include a user readable display configured to display values representative of the temperature within the refrigerated area. Further such user interface may comprise a control panel configured to permit manual programming of operational characteristics of the access control circuit by observation of such user readable display. In still other optional configurations, such a refrigerated area access control system may further include a computer interface associated with such user interface, and a computer, with such computer preferably configured to permit such second user to adjust system operational parameters comprising one or more of adding credentials for first users, deleting credentials for first users, and adjusting temperature based parameter settings.

In various of the foregoing embodiments, such lock may comprise a motorized slam bolt latch. In other exemplary embodiments, such system may further include an alarm configured to be activated when the temperature within the refrigerated area is not maintained with such predetermined parameters. In others, a memory may be optionally associated with such access control circuit, with such circuit preferably configured to store in such memory a number of different valid credentials to be used to access such refrigerated area, an audit trail for each access to such refrigerated area, and data logging at predetermined time periods of temperature readings within such refrigerated area. Likewise, still further, such system may include a credential presentation device consisting of at least one of a key pad, an electronic card reader, a biometrics reader, and a computer interface.

It should be further understood that the various foregoing exemplary embodiments may involve a such refrigerated area comprising a refrigerator, with such access control system configured to be retrofittable to such refrigerator.

In other present exemplary embodiments, such refrigerated area access control system may optionally include a temperature modulator associated with the temperature transducer, which temperature modulator is configured to provide thermal shock protection for such thermal transducer.

It should be understood that the present subject matter equally pertains to corresponding methodology. One exemplary present method comprises a method of providing access to a refrigerated area. Such exemplary method may include providing an access control circuit; monitoring temperature variations within the refrigerated area, for maintenance of such temperature variations within selected predetermined parameters; providing respectively differentiated access to the refrigerated area to a first user having a first credential enabled access level and to a second user having a second credential enabled access level; and denying access to the refrigerated area by a first user if the temperature within the refrigerated area is not maintained within the selected predetermined parameters.

Present alternative embodiments of methodology may further optionally involve providing a user interface including a display and a control panel; and permitting the second user to add first user credentials, delete first user credentials, and adjust temperature based parameters. Other alternative features may involve providing an alarm signal when the temperature within the refrigerated area is not maintained within the selected predetermined parameters for a predetermined period. In other present alternatives, providing second user access may comprise providing a user interface including a computer interface; associating a memory with the access control circuit; storing temperature measurement data in the memory; and providing a computer configured to permit the second user to upload data to the memory to add first user credentials, delete first user credentials, and adjust temperature based parameters, and to download and display stored data.

Other present exemplary methodologies may alternatively involve monitoring access events by first and second users; and storing an audit trail of the access events in the memory.

Optionally, providing an access control circuit may include retrofitting such access control circuit to an existing refrigerated area.

Additional objects and advantages of the present subject matters are set forth in, or will be apparent to, those of ordinary skill in the art from the detailed description herein. Also, it should be further appreciated that modifications and variations to the specifically illustrated, referred and discussed features and elements hereof may be practiced in various embodiments and uses of the present subject matters without departing from the spirit and scope of the subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the present subject matters may include various combinations or configurations of presently disclosed features, steps, or elements, or their equivalents (including combinations of features, parts, or steps or configurations thereof not expressly shown in the Figures or stated in the detailed description of such Figures). Additional embodiments of the present subject matters, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE DRAWINGS

A full and enabling disclosure of the present subject matter, including the best mode thereof, directed to one of ordinary skill in the art, is set forth in the specification, which makes reference to the appended Figures, in which.

Figure 1:
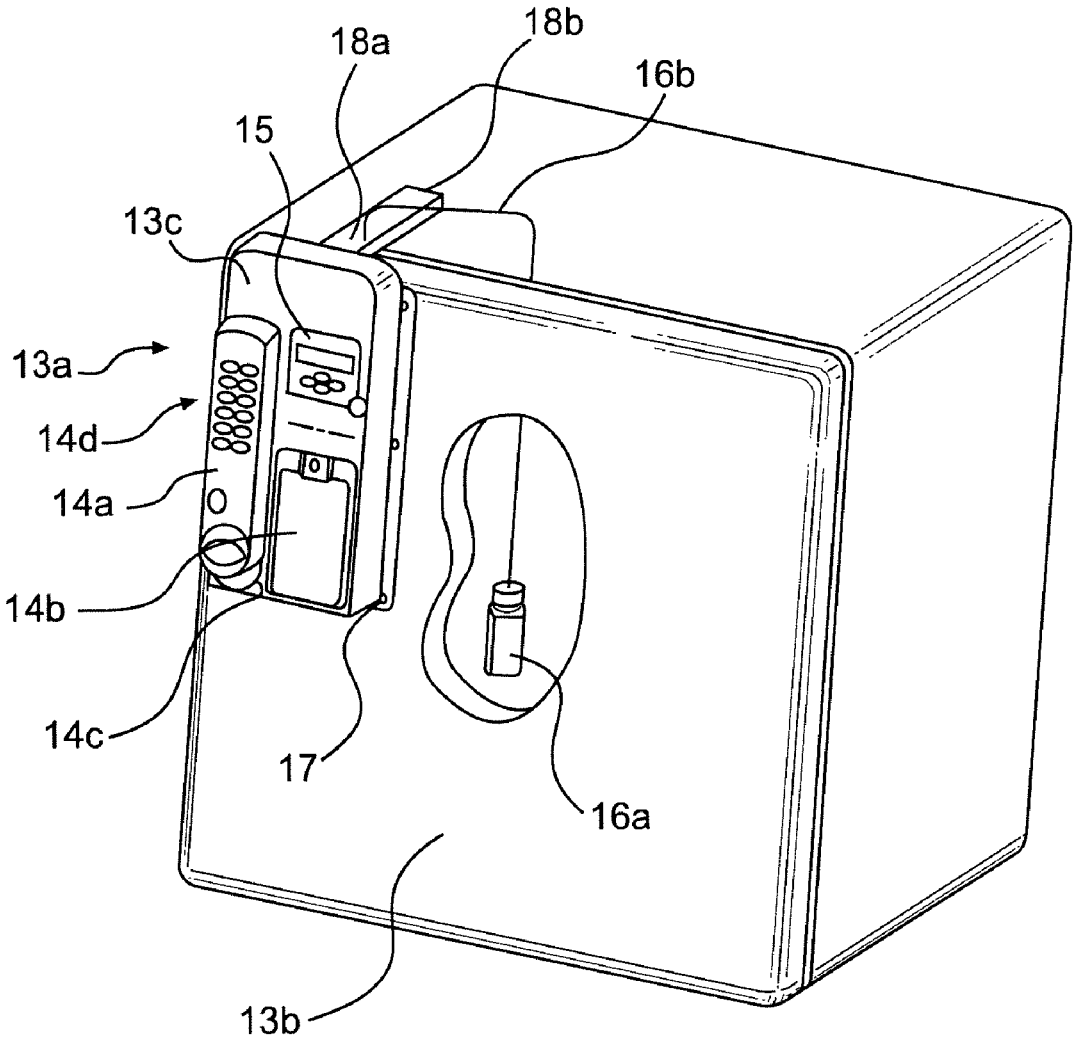
FIG. 1 is an upper right isometric view of an exemplary representative refrigerator with the door thereof in a closed and locked position with a lock provided in accordance with the present technology installed thereon, and illustrating the door thereof in partial cutaway for illustration of various present features internal to such refrigerator.

Repeat use of reference characters throughout the present specification and appended drawings is intended to represent same or analogous features, elements, or steps of the present subject matter.

DETAILED DESCRIPTION OF THE PREFERRED EMBODIMENTS

As discussed in the Summary of the Invention section, the present subject matter is particularly concerned with controlling access to refrigerated storage areas.

Selected combinations of aspects of the disclosed technology correspond to a plurality of different embodiments of the present subject matter. It should be noted that each of the exemplary embodiments presented and discussed herein should not insinuate limitations of the present subject matter. Features or steps illustrated or described as part of one embodiment may be used in combination with aspects of another embodiment to yield yet further embodiments. Additionally, certain features may be interchanged with similar devices or features not expressly mentioned which perform the same or similar function.

It should be specifically noted that while the present disclosure generally describes the lock disclosed herein as a retrofittable lock, such terminology should not be taken as a limitation of the present subject matter in any way as the presently disclosed lock may, indeed, be provided as original equipment.

The present subject matter relates in part to a motorized latch and an electronic access control circuit mounted within a plastic housing and provided as a retrofittable lock for a refrigerator. A user interface may be provided through an LCD display and control panel mounted on the face of the housing. Additionally, a temperature transducer which is continuously monitored by the electronic access control circuit is provided for installation within a temperature controlled compartment. The housing may be easily mounted to most small refrigerators in minimal time, with minimal tools, and without disassembly of the refrigerator. The temperature transducer and its associated wiring back to the control circuit are also easily installed within the refrigerator with minimal interference with the door seal. The main assembly mounts to the refrigerator door with tamper resistant sheet metal screws, double sided tape or by other appropriate securing means including, for example, pop-rivets. The motorized latch in the main assembly may engage a rectangular hole in the strike, preventing the refrigerator door from being opened.

The LCD display continuously displays current temperature within the controlled enclosure and in conjunction with the control panel allows changes to be entered to the temperature based programmable settings. Additionally, the unit functions to provide access control to the enclosure. The unit quickly unlatches upon presentation of a valid access credential by the user: typically a key pad entered PIN or electronic card. The control circuitry allows for a large number of different valid credentials to be used for access and has the ability to record each entry creating an "audit trail". The "audit trail" consists of the card or PIN number that gained access as well as the date and time of access. A significant history can be developed limited only by the size of the memory chips in the controller.

The temperature transducer can be one of several different types including, but not limited to, thermistors and thermocouples. The function of the temperature transducer is to return a voltage to the control circuit proportional to the temperature of its environment. The control circuit then converts this voltage to the temperature value displayed by the LCD display and used in the temperature based programmable settings. An associated microprocessor may be preprogrammed with a conversion table that allows it to very accurately determine the temperature of the transducer environment. However, it is possible to adjust this table on a per-unit basis to provide additional accuracy, through calibration.

It may be desirable to modulate the temperature extremes experienced by the transducer caused by opening of the refrigerator door. This can be done by placing the transducer in a small bottle of fluid known to exhibit the thermal properties similar to most medications. This method of temperature modulation provides a "thermal shock absorber" and more accurately reflects the temperature of the stored medications.

Before entering service, the administrator of the temperature based access control system configures the system to the individual needs of the installation. That is, they set the: 1) highest acceptable temperature to which that medication can be exposed; 2) the lowest acceptable temperature to which that medication can be exposed; 3) the maximum amount of time that the medication can be outside of the "temperature window" set in 1) and 2); 4) whether or not to sound an alarm if the "temperature window" set in 1) and 2) is violated for a time exceeded by the setting in 3); 5) the alarm volume; 6)

whether or not to sound a remote alarm, drawing attention to someone outside of the audible range of the system and finally; 7) whether or not to restrict access to supervisors once an alarm has sounded. Additionally users have the ability to choose between Fahrenheit or Celsius temperature display units and are provided with the ability to mute the alarming system.

The temperature based access control system also provides a data-logging feature. In other words, users will have the ability to view and download a temperature history of the refrigerator. This history can be viewed by pressing an "up" button on the keypad, which will display the maximum observed temperature; or by pressing a "down" button on the keypad, which will display the minimum observed temperature. The data can be logged in one minute increments with the size of the increment being set by the system administrator. In addition to viewing the max/min observed temperatures, the system is provided with the ability to connect a personal computer (PC) and download the data containing the historical temperature record of the enclosure. This data can be viewed in the raw state, or processed into a chart providing the user with a "strip chart" style reading of temperature versus time. The scales of the charting are adjustable by the user. There are additional data manipulations features, well understood by those of ordinary skill in the data processing art without requiring additional detailed discussion, including downloading to a database for manipulation by a spreadsheet style program.

An individual attempting access to the refrigerator will present their access control credential (PIN, magnetic stripe card, proximity card, biometric, etc) to the access control circuitry through a relevant reader. The access control circuitry compares the credential to a known list of valid credentials and determines validity. If the credential is valid and the temperature alarm is not active, access will be granted. If the alarm is active, access will only be granted to supervisors when this feature is enabled.

According to an exemplary embodiment of the present technology, a motor/gear train assembly may be used to retract a slam latch bolt. A gear motor housing is attached to the inside of the main lock housing, which is attached to the front of the refrigerator door. In the normal or locked state, a latching bolt protrudes from the top of the lock assembly engaging a strike plate mounted on top of the refrigerator. The interaction of the latching bolt and the strike plate prevents someone from surreptitiously gaining access to the refrigerator. When the slam latch bolt is drawn in, it is pulled out of the strike, which is attached to the top of the refrigerator, allowing the refrigerator door to be opened.

Operation of the lock may proceed as follows. For purposes of this description, the starting point will be with the refrigerator locked and a nurse attempting to enter the refrigerator to acquire narcotics. To begin the open cycle, the nurse enters a credential or presents a biometric to the electronic lock. The access control circuitry compares the credential (or biometric) to a known list of valid credentials or biometrics, respectively. If the credential or biometric is deemed valid, the access control circuitry then checks the status of the temperature alarm. If the alarm has sounded, (normally due to the fact that the temperature transducer has been outside of a preprogrammed set of temperature limits for a preprogrammed amount of time) the access control circuitry then checks if the credential presented is approved for entry under this alarm condition if such feature is so enabled.

In such exemplary embodiment, there are two access levels: user and supervisor. In other embodiments, additional or fewer access levels may be provided. The circuitry can be preprogrammed to deny normal users' access to the refrigerator after the alarm has sounded. In instances where an alarm has sounded, only supervisory level credentials will be permitted entry, reducing the chances that medications which may now be ineffective (due to incorrect storage temperature conditions) will be inadvertently used.

If the presented credential does not have supervisor status, the access control circuitry then communicates to the user through a display, beeper, LED or other suitable means that the alarm has sounded and only a supervisor can access the refrigerator. The system administrator has the option of allowing supervisor access only in the alarmed state or to continue to allow access to all users with valid credentials. Upon validation of access permission, the access control circuit will then energize the motorized latch, retracting the slam bolt into the latch housing, allowing the refrigerator door to be opened.

When the locking bolt is drawn into the motorized latch housing, it is also drawn into the main lock assembly. The latching bolt may be spring loaded by a return spring, biasing the latching bolt out of the motorized latch housing. Such action removes the blocking interaction between the latching bolt and the strike plate, allowing the nurse (or other authorized entrant) to open the refrigerator.

The latching bolt remains drawn into the motorized latch housing for a programmable amount of time allowing the nurse (or other authorized person) to open the refrigerator door and gain access to the contents of the refrigerator. In an exemplary embodiment, the programmable amount of time may correspond for example to five seconds. Upon expiration of the open delay timer, the motorized latch releases the latching bolt. It then re-extends out of the latch housing and out of the main assembly housing. The latching bolt is now in position to re-lock the refrigerator door upon its closing.

When the nurse has completed accessing the refrigerator, the nurse will slam the refrigerator door. This action will cause the latching bolt to hit the strike plate. The end of the latching bolt and the end of the strike plate are each provided with cam surfaces which cause the latching bolt to push into the motorized latch housing when the refrigerator door is closed. When the latching bolt pushes into the motorized housing, the return spring is again charged. The strike plate is provided with a rectangular cutout section, located just past the cam surface, which is designed such that the latching bolt will enter it as the refrigerator door closes.

After the latching bolt is pushed into the motorized latch housing and the door continues to close, the tip of the latching bolt travels on the bottom of the strike plate for some distance. Eventually, the tip encounters the rectangular cutout on the strike plate and the charged spring on the latching bolt causes it to re-extend from the motorized latch housing, entering the rectangular cutout section of the strike, and locking the refrigerator (or, that is, the door of the refrigerator). The microprocessor then records the event, recording the card/pin number that accessed the refrigerator as well as the date and time. In an alternative configuration, the microprocessor may be configured to record events including card/pin number and time and date at the time access occurred in place of or in addition to recording at door closure. Recording data upon initial access would preclude possible loss of access data if the refrigerator door remains open accidentally or intentionally.

As described above, there are numerous settings for the temperature monitoring and access control systems. These include (but are not limited to) temperature limit settings, alarm status, supervisor status required for entry after alarm settings, as well as the list of valid credentials or biometrics. In accordance with the present subject matter, such settings can be made through a control panel on the front of the system, or through a PC based access control system.

Using the front panel programming method, the access control system requires the lock to be accessed by a supervisor first. Once supervisor access has been performed, there are three menu systems that can be accessed: add valid credentials, delete valid credentials and temperature based settings. The add valid credentials menu has the option of simply teaching the system valid credentials, by credential presentation, (allowing the system to choose the memory location) or by having the user tell the access control into which memory location to put a valid credential. In accordance with an exemplary embodiment, 250 different memory locations may be provided, but such number can easily be expanded (or reduced) by those skilled in the art, as desired. Therefore, the details of such aspect of such feature form no particular aspect of the present subject matter.

Deleting selected valid credentials is just as simple with a delete valid credentials menu. Such menu also has the option of simply teaching the system invalid credentials, by invalid credential presentation. Clearing of invalid credentials may be achieved by allowing the system to find the memory location in which the invalid credential resides, and clearing it, or by having the user tell the access control which memory location to clear. It is preferred, although less convenient, to tell the lock which memory location to clear, as the invalid credential is not needed to perform such programming. Typically, the credential that the user wants to invalidate is not available to re-present to the lock due to the fact that it is lost or in the possession of the person for whom it is desired that access no longer be provided.

The third front panel menu system that can be accessed after a valid supervisor access is the temperature based settings menu. Such menu allows the supervisor to enable the alarm, set the high temperature limit, set the low temperature limit, choose the units of measure (Fahrenheit or Celsius), silence an alarm which is currently active, or reset the observed maximum or minimum temperature settings. Such programming system is menu based, allowing the supervisor to first choose which setting to adjust, and then to set the new value.

It may be simpler (although sometimes less convenient, as a PC is required) to use a PC based access control system to provide desired settings. Using a PC system, valid credentials may be easily stored, access rights assigned between desired users and locks, and information easily uploaded into the lock. Such a system may be provided to allow easy setting and uploading of the previously described temperature based settings. In addition to such settings, the supervisor can also set the required access level in the event of a sounded alarm. If set, such will require a user to have supervisor status in order to access a lock system which is alarming.

Additionally, the system in accordance with the present subject matter has been configured to provide data logging. In other words, the temperature based circuitry can be set to not only monitor the ambient temperature of the temperature transducer, but also to store observed settings. The frequency of such recordings can be set in integer multiples of minutes, as low as one minute. It is further possible to set the logging frequency to be different if the alarm is sounding or not. For example, the supervisor can set up the system to log the temperature every 10 minutes if the temperature is within the desired operating window and every 2 minutes if it is outside of such window.

The program also has the ability to download the logged data and display it in graphical form. Such functionality will provide a virtual strip chart (observed temperature with respect to time) that the supervisor can use. The scales of the strip chart are easily adjustable depending on the supervisor's needs or preferences. Finally, the hard data can be exported into a text file for manipulation within a spreadsheet.

Reference will now be made in detail to the presently preferred embodiments of the subject refrigerator lock. Referring now to the drawings, FIG. 1 illustrates an upper right perspective of a refrigerator 13*b* with the door in the closed and locked position with a lock 13*a* in accordance with the present technology installed thereon. Lock 13*a* includes a main housing 13*c*, electronic assembly 14*a*, battery pack 14*b*, communications port 14*c*, and programming keypad and display 15. Lock 13*a* is attached to refrigerator 13*b* with a plurality of screws collectively and representatively noted as screw 17. Lock 13*a* is configured to engage a strike assembly 18*a* that, when properly positioned, keeps the refrigerator locked. Strike assembly 18*a* may be attached to refrigerator 13*b* by screws or by other appropriate means including, but not limited to, pop-rivets, double sided tape, adhesives, and welding. As illustrated with the partial cutaway of the door of refrigerator 13*b*, electronic assembly 14*a* is electrically connected to thermistor assembly 16*a* by way of cable 16*b*.

Figure 2:
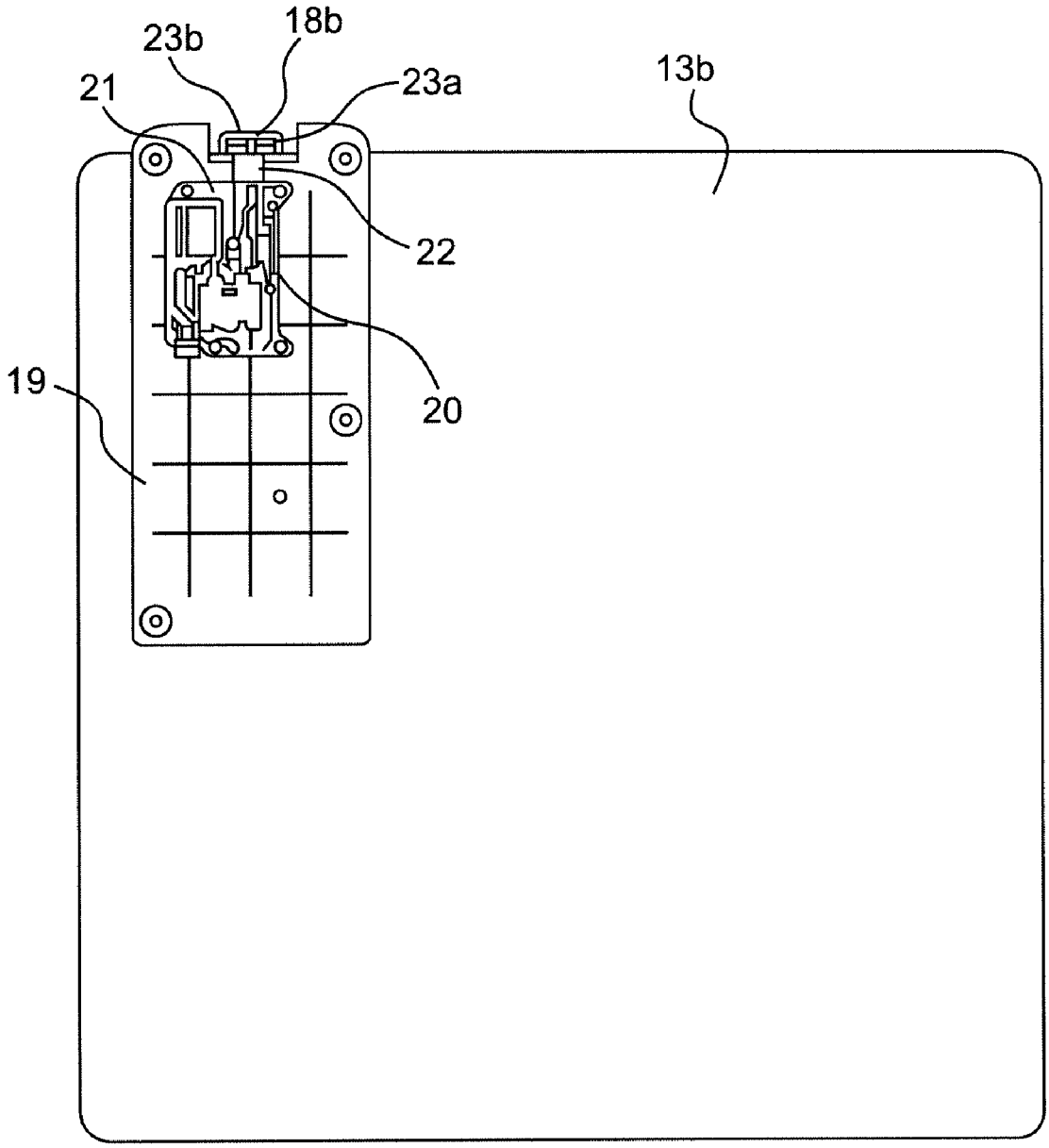
FIG. 2 is a front elevation view of a refrigerator in accordance with the present technology and illustrating a lock with cover portions thereof removed and with a latch bolt thereof engaging a present exemplary strike plate.

With reference now to FIG. 2, there is illustrated a front elevation view of a refrigerator 13*b* in accordance with the present technology and illustrating a lock 13*a* with cover portions removed and the latch bolt 22 engaging a strike plate 23*a*. A back cover 23*b*, shown for reference purposes, may be attached to main housing 13*c* with screws (not illustrated) or by other appropriate means. Motorized latch assembly generally 20 is attached to main housing 13*c* with a plurality of screws 21 exemplarily and representatively noted by screw 21. Latch assembly 20 is provided with latch bolt 22 which engages an opening in strike plate 23*a* in the locked position to keep refrigerator 13*b* locked. Strike plate 23*a* is attached to the top of the refrigerator with mounting screws (not illustrated) and may be provided with a cover 23*b* which may be attached to strike plate 23*a* with a plurality of screws 18*b* or by other appropriate means.

Figure 3B:
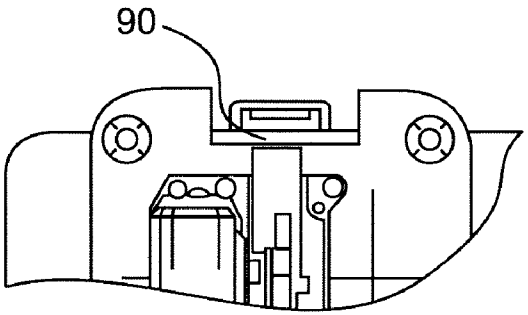
FIG. 3B illustrates an isolate, enlarged view of a portion of exemplary lock illustrated in FIG. 3A, and illustrating in greater detail the retracted latch bolt thereof.
Figure 3A:
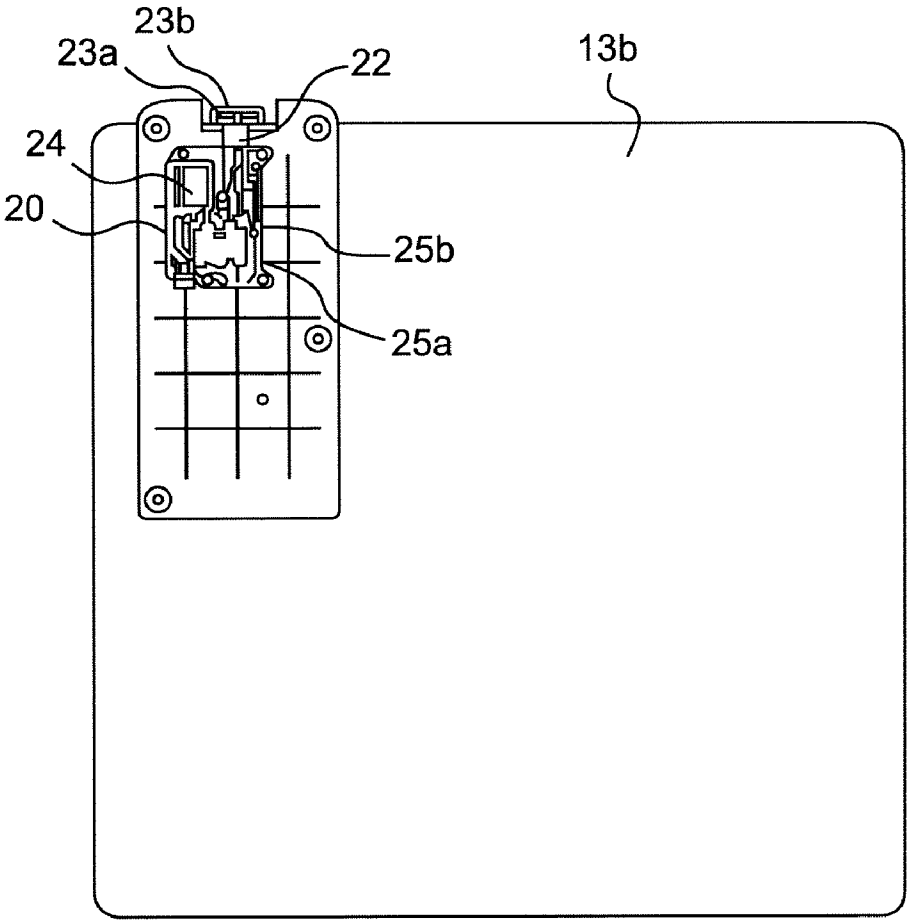
FIG. 3A is a front elevation view of a refrigerator similar to that of FIG. 2 but partially illustrating internal components of an exemplary latch thereof with the latch bolt retracted.

With reference to FIGS. 3A and 3B, there are illustrated, respectively, a front elevation view of a refrigerator 13*b* illustrating internal components of motorized latch 20 with latch bolt 22 retracted, and an enlarged view of a portion of such lock illustrating retracted latch bolt 22. Those of ordinary skill in the art will appreciate that in accordance with broader aspects of the present subject matter, various mechanisms can be used to accomplish the same end result, i.e., the retraction of bolt 22 into the motorized latch 20, and that the illustrated mechanism corresponds to an exemplary such method and related apparatus.

The prime mover in motorized latch 20 is motor 24. In an exemplary embodiment, a permanent magnet DC motor may be used. However, various types of motors may be employed, per the broader aspects of the present subject matter. Motor 24 may be provided in conjunction with gear train 25*a* that moves mechanism 25*b*, which in turn retracts latch bolt 22 into latch 20. When latch bolt 22 is retracted, the blocking interaction of latch bolt 22 with strike plate 23*a* is removed, as shown in greater detail with reference numeral 90 in enlarged FIG. 3B.

Figure 4A:
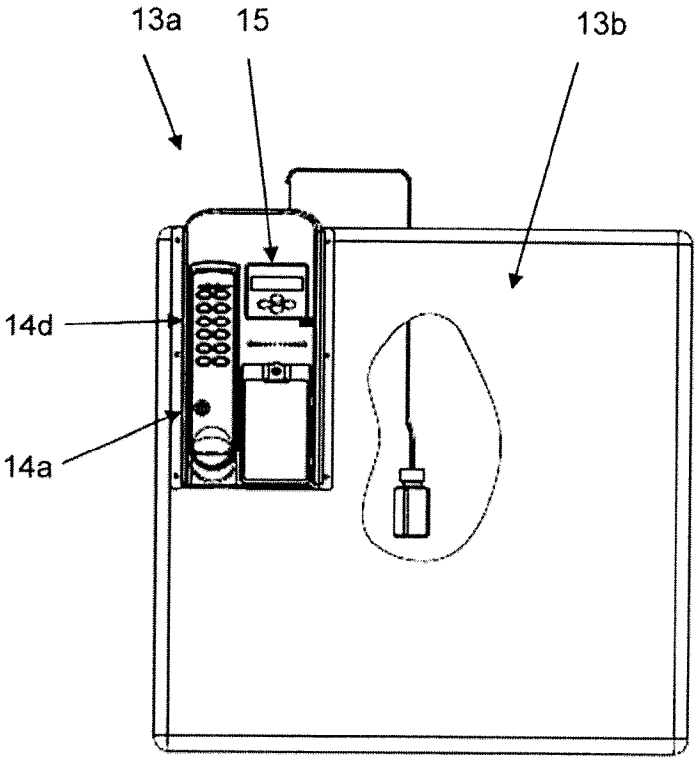
FIG. 4A is a front elevation view of a refrigerator having a lock installed thereon and illustrating a control panel including navigation keys for programming certain operational characteristics of the lock in accordance with the present technology, and illustrating the door thereof in partial cutaway for illustration of various present features internal to such refrigerator.
Figure 4B:
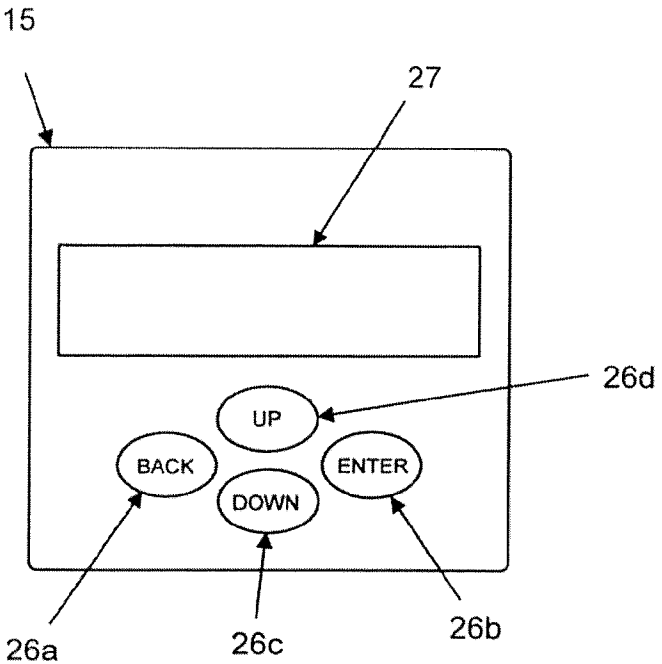
FIG. 4B is an enlarged portion of the control panel of present FIG. 4A, particularly illustrating exemplary navigation key features thereof.

With reference to FIG. 4A, there is illustrated a front elevation view of a refrigerator 13*b* having a lock 13*a* installed thereon and illustrating an electronics assembly 14*a* including a control panel 15 and navigation keys 26*a*, 26*b*, 26*c*, and 26*d* for programming certain operational characteristics of the lock in accordance with the present technology. FIG. 4B illustrates an enlarged portion of such exemplary control panel 15, particularly illustrating the navigation keys 26*a*,

26*b*, 26*c*, and 26*d* and display 27. It is to be understood that the broader aspects of the present subject matter encompass various placements of such navigation keys and display relative to each other.

Motor 24 (FIG. 3B), and thereby latch bolt 22, is operated per present subject matter preferably under the control of a microprocessor based circuit (or equivalent) located within electronics assembly 14*a*. In accordance with the illustrated exemplary embodiment of the present technology, electronics assembly 14*a* receives input from a user attempting to gain access to the refrigerator 13*b* via the keypad 14*d* of electronics assembly 14*a* (FIGS. 1 and 4A). It should be appreciated by those of ordinary skill in the art that a variety of different types of access control credentials may be used instead of or in addition to the electronics assembly 14*a*. Such credentials may include, but are not limited to, proximity cards, magnetic stripe cards, smart cards, RF fobs, IR fobs, and Dallas semiconductor i-Buttons, as well as a plethora of biometric type access control technologies available to industry.

When the electronics assembly 14*a* receives data, in this exemplary case a personal identification number (PIN) from a user, the electronics assembly 14*a* processes the PIN and determines the validity of the code. Typically, electronics assemblies of this type will have a number of available valid codes. In accordance with an exemplary embodiment, 250 valid codes may be provided. It should be appreciated, however, that such number is a design limitation determined primarily by specific needs associated with a particular installation of lock model and the amount of memory installed in the device, as opposed to being a limitation of the present subject matter.

The electronics assembly 14*a* is configured to compare an entered PIN (or other coded identification) to its list of preprogrammed valid codes. If the code is determined to be valid and the temperature alarm is not currently active, access is granted and the electronics assembly 14*a* turns on motor 24. If the alarm is active, access will only be granted to supervisors when such feature is enabled. The alarm function can be programmed manually (as is otherwise described herewith reference to FIG. 5), or through a personal computer (PC) based program (as otherwise described with reference to FIG. 6).

With further reference to FIG. 4A, it will be seen that the front of the lock assembly 13*a* includes in the illustrated exemplary configuration a keypad 15. Keypad 15, illustrated in enlarged detail in FIG. 4B, is provided with a back button 26*a*, an enter button 26*b*, a down button 26*c*, an up button 26*d*, and a display 27. In an exemplary embodiment, display 27 may correspond to an LCD display; however, other types of displays may also be employed. Such buttons and the display are used to navigate a menu based programming scheme. The programming scheme is used to select or unselect various programming options within a lock constructed in accordance with the present technology. Such programming menu can only be accessed by persons (hereafter referred to as a "supervisor") who have a relatively higher level of security access than that of the typical user.

Figure 5:
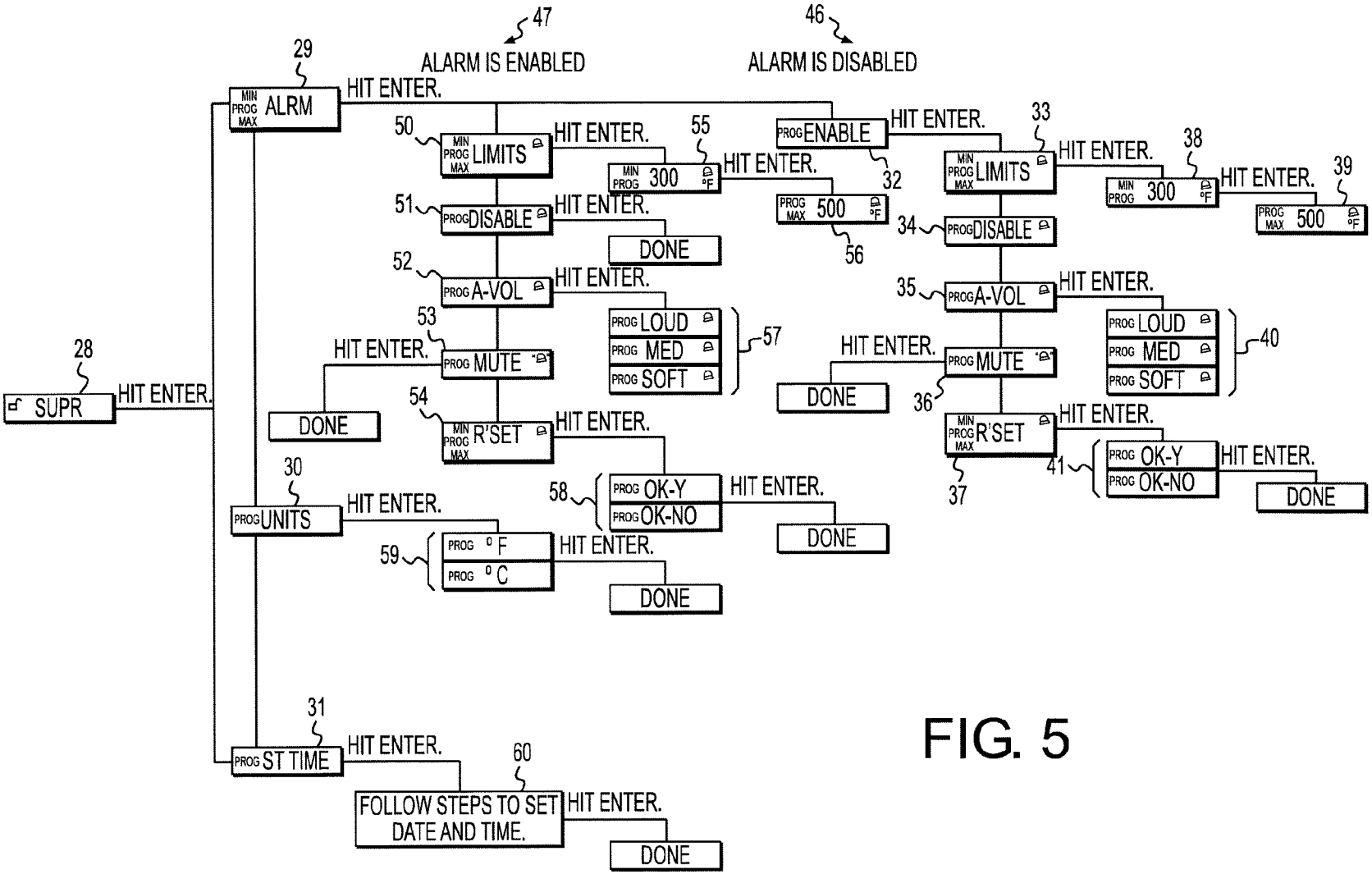
FIG. 5 is a pictorial flowchart of exemplary manual programming menus available for programming certain operational aspects of an exemplary lock in accordance with present technology.

With reference now to FIG. 5, there is illustrated a pictorial flowchart of the manual programming menus (programming "tree") available for programming certain operational aspects of the lock in accordance with present technology. Navigation of the programming tree is accomplished using the enter button 26*b* (FIG. 4B) to go one level deeper into the tree or to accept a setting if you are at the end of a tree "branch", the back button 26*a* to go one level higher in the tree, the up button 26*d* to scroll up through the options available at the current tree level, and the down button 26*c* to scroll down through the options available at the current tree level.

The images illustrated in FIG. 5 represent those as may be displayed on exemplary LCD display 27. These images, of course, are limited to the number of characters on the display but those of ordinary skill in the art could easily employ other display technologies (for example LED based displays and TFT displays) limited only by the scope of the desired cost. For clarification purposes with reference to the following discussion, any words that appear as abbreviations on the illustrated display will be discussed without abbreviation. For example, point 31 reads "St Time" which is abbreviated for "Set Time" and would be referred to as such.

As previously noted an individual assigned a higher level of security, referred to as the supervisor, enters their PIN number into the electronics assembly 14*a* (and/or shows a credential or biometric) and if the credential is a valid supervisor credential, the menu illustrated in FIG. 5 can be accessed, at point 28. The supervisor can then scroll between three options: alarm 29, units 30, and set time 31. If the supervisor chooses alarm 31, the alarm branch of the menu tree is entered.

The alarm branch 29 consists of two main paths, one (shown by reference numeral 47) if the alarm was enabled when the supervisor entered the programming tree, and one (shown by reference numeral 46) if the alarm was not enabled (i.e., the alarm is disabled) when the supervisor entered the programming tree. For purposes of this discussion, first we will assume the alarm was disabled when the supervisor entered the programming tree, therefore we will begin at the tree branch noted by reference numeral 46.

If the supervisor wishes to enable the alarm, they will be prompted with the enable prompt 32. If the supervisor then enables the alarm by pressing enter 26*b*, the following options are available: limits 33, disable 34, alarm volume 35, mute 36, and reset 37. Such options are easily scrollable with the up button 26*d* and the down button 26*c*. When the desired option is reached, the supervisor presses enter 26*d*.

The limits option 33 allows the supervisor to set the temperature window in which the alarm will not sound. Typically, this is the maximum and minimum temperature at which narcotics or vaccines can safely be stored without damage. Once the limits option 33 is chosen, the supervisor selects the minimum temperature 38 and the maximum temperature 39. The desired temperatures can be entered directly on the keypad on the electronics unit 14*a* or may be scrolled with the up 26*d* and down 26*c* arrows.

The disable option 34 allows the supervisor to silence the temperature alarming features. The alarm volume option 35 allows the supervisor to choose the relative alarm volume: loud, medium or soft 40. The mute option 36 allows the supervisor to temporarily turn off the alarming feature. Such may be desirable in certain instances, for example, as the medium and loud settings can be disrupting in a noise sensitive environment (i.e., hospital, doctor's office, etc.).

The temperature monitoring system has the ability to display the minimum and maximum temperatures recorded since the last time such feature was reset. Typically, the person in charge of the temperature of the narcotics can see the minimum temperature (since last reset) by pressing the down button 26*c* and the maximum temperature (since last reset) by pressing the up button 26*d*. If the supervisor desires to reset such option, they choose the reset option 37. As it is not possible to "undo" this choice, the supervisor must confirm this selection at step 41.

If the alarm was already enabled when the supervisor entered their credential and they entered the alarm branch at point 29, the menu will follow the path generally noted by branch 47. Such branch is very similar to branch 46 except that the alarm does not need to be enabled first, as it is already on. Once the operator chooses the alarm branch 47, the following options are available: limits 50, disable 51, alarm volume 52, mute 53, and reset 54. Such options are easily scrollable with the up button 26*d* and the down button 26*c*. When the desired option is chosen, the supervisor presses enter 26*d*.

The limits option 50 behaves exactly as previously described, choosing the minimum alarming temperature at step 55 and the maximum temperature at step 56. The disable option 51 behaves as previously described. The alarm volume option 52 behaves as previously described, allowing the supervisor to choose the relative alarm volume: loud, medium or soft 57. The mute option 53 behaves as previously described. The reset option 54 behaves as previously described with the confirmation at step 58.

Returning to the original options presented to the supervisor after entering their credential, it will be seen that there are two other options available, aside from alarm based options 46, 47. They are units 30 and set time 31. Units option 30 allows the supervisor to choose Fahrenheit or Celsius as the unit of temperature measure. Such selection is performed at step 59. The set time option 31 allows the supervisor to set the year, month, date, hour and minute at step 60.

The programming menu tree just described can typically only be entered by a supervisor, that is, an individual assigned a relatively higher level of security (authorization) clearance. There are circumstances, however, where it might be desirable to allow persons with relatively lower security clearance (hereafter called a "user") to perform some or all of such programming features. Further, there are additional features that do not lend themselves to simple programming with a small LCD display and four buttons. It will be appreciated by those of ordinary skill in the art that manufacturing products at a higher cost level could easily integrate additional features and selections into the subject manual programming tree, given an understanding of the present subject matter as herein described. All such variations are intended to come within the scope of the presently disclosed subject matter.

Figure 6:
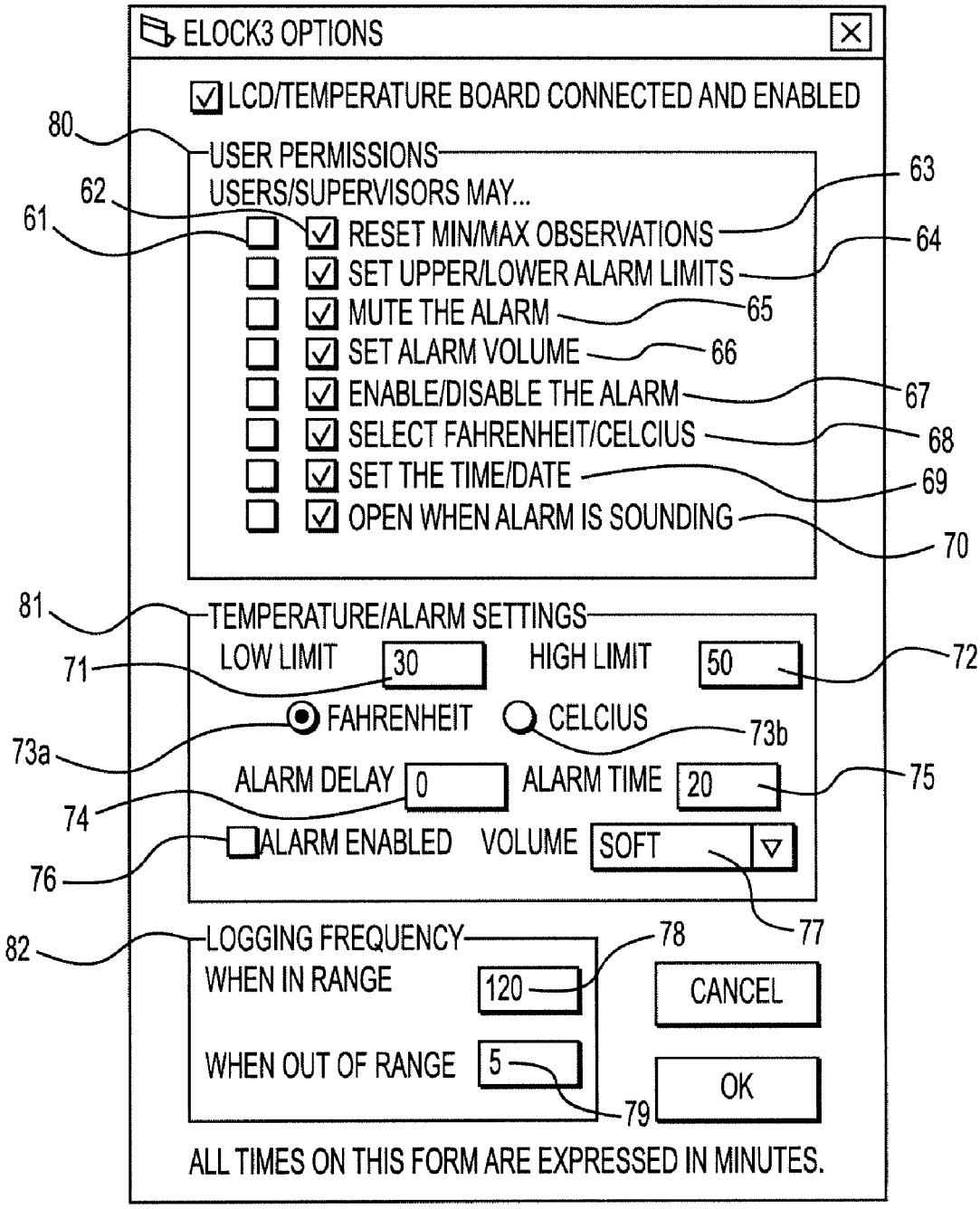
FIG. 6 is a screen capture of exemplary computer based programming menus alternatively available for programming certain operational aspects of the present lock in accordance with present technology.

In accordance with the present technology, a personal computer (PC) based program may be employed to provide additional optional programming capabilities, as illustrated and represented in FIG. 6. FIG. 6 illustrates a screen capture of an input portion of an exemplary PC based program that may be employed in accordance with present technology to program selected lock related options. Such screen is divided into an upper section called user permissions 80, a middle section called temperature/alarm settings 81, and a lower section called logging frequency 82.

The user permissions section 80 is used to select which options in the previously described programming tree are open to supervisors and which are open to users. The column of check boxes generally referred to with reference numeral 61 denote which options are available to users. The presence of a check mark in this example denotes that users can use the corresponding option and the absence of a check mark in this example denotes that users cannot use the corresponding option. Similarly, the column of check boxes generally referred to with reference numeral 62 denote which options are available to supervisors. The presence of a check mark denotes that supervisors can use the corresponding option, and the absence of a check mark denotes that supervisors cannot use the corresponding option.

In the exemplary configuration of the present technology illustrated herein, eight selectable options are illustrated. It will be appreciated by those of ordinary skill in the art, however, that such available options could be increased or decreased, all within the overall scope of the present subject matter. Such exemplary options include the ability to reset the minimum and maximum observed temperatures 63. Such reset option corresponds to previously discussed manual programming steps 37 and 54. A number of additional options have similar correspondence to previously discussed manual programming steps. Thus, high and low temperature limits 64 correspond to previously discussed manual programming steps 33 and 50; the ability to mute the alarm 65 corresponds to manual programming steps 36 and 53; the ability to set the volume of the alarm 66 corresponds to manual programming steps 35 and 52; the ability to enable and disable the alarm 67 corresponds to manual programming steps 32, 34 and 51; the ability to set the units of temperature measure (Fahrenheit or Celsius) 68 corresponds to manual programming step 59; and the ability to set the date and time 69 corresponds to manual programming steps 31 and 60.

A final exemplary setting option is not available for manual selection in this exemplary configuration. Typically, after a user or supervisor enters their credential, the electronic locking mechanism opens and allows access to the refrigerator. There are instances, however, where additional attention needs to be drawn to the fact that the electronics are in the alarming state (the case where extremely critical vaccines are being stored, for example). Such option can be selected in row 70. If the user box is checked, users will be allowed to access an alarming system. If it is not selected, they will not be able to access the refrigerator. In the case of a supervisor, if the supervisor box is not selected, they will be forced to MUTE the alarm before gaining access.

Turning now to the middle section 81 of the PC based programming screen, it will be seen that the exemplary actual temperature and alarm settings are displayed. The high temperature alarm setting is shown at point 71 and the low temperature setting is shown at point 72. Such values can be easily highlighted and changed. The units of measure will be displayed per those previously selected, either Fahrenheit 73*a* or Celsius 73*b*.

There might be the need to delay for some amount of time the alarm sounding after the thermistor 16*a* has experienced temperatures outside the temperature window set at points 71 and 72. If the operator of the PC program wishes to add such delay, they may do so at points 74 and 75.

The selection box noted by reference numeral 76 illustrates whether or not the alarm is currently enabled. The operator of the program has the ability at this point to change the setting. The pull down menu noted by reference numeral 77 illustrates the current volume setting. The operator of the program has the ability at this point to change the setting.

Figure 11:
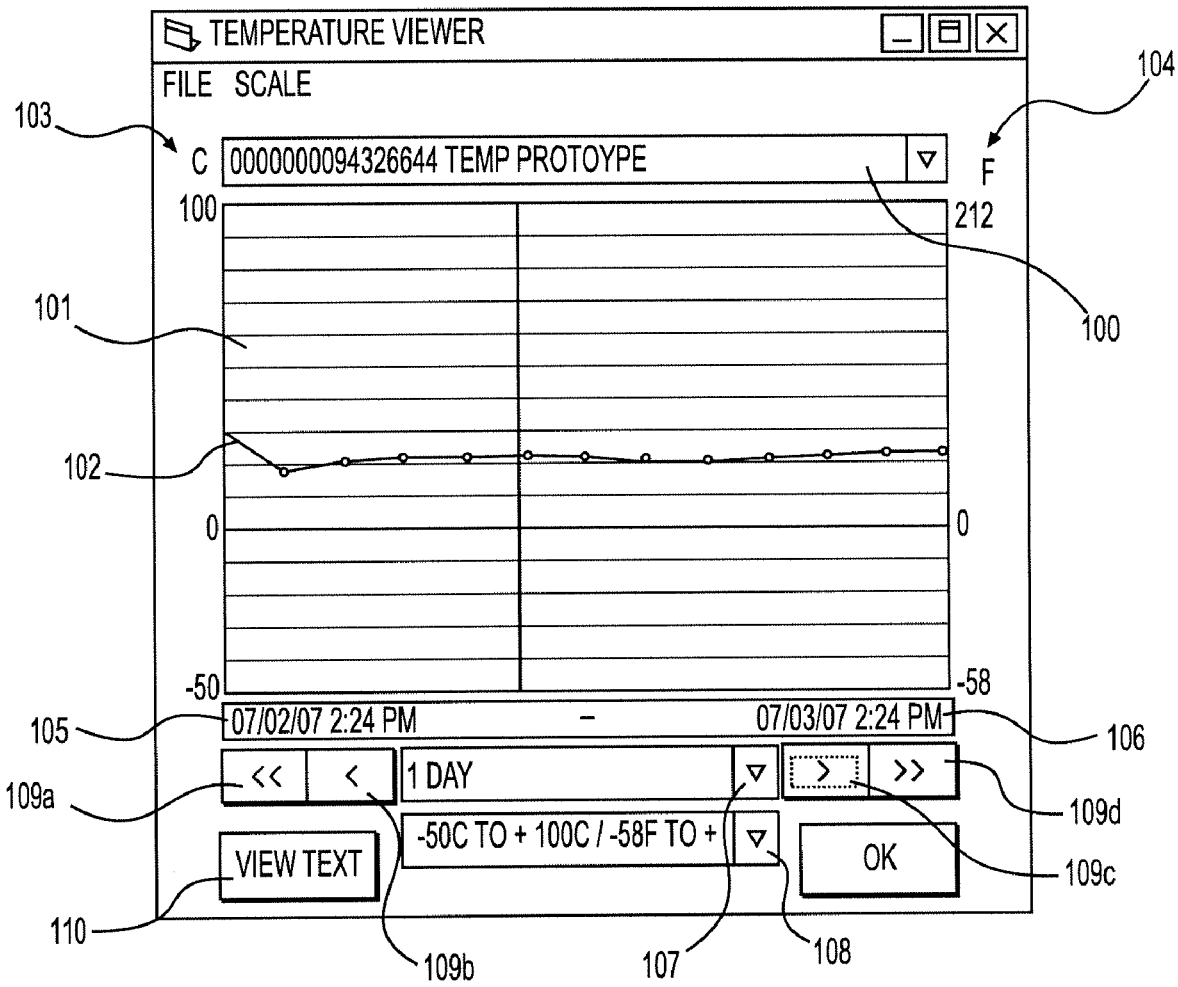
FIG. 11 is an illustration of an exemplary computer generated output of a temperature data logging feature in accordance with present technology.

The PC based program has the ability to log or record the temperatures observed at the thermistor 16*a*. The frequency (in minutes) is shown and selected in the lower section 82 of the PC based programming screen. The operator can choose the amount of time between recorded temperature measurements while the recorded temperature is inside the temperature window chosen at points 78 and 79 and while outside such window. Typically, the operator will want more accurate (higher resolution) data when the refrigerator is outside the window. The frequency inside the temperature window, denoted as "when in range", is illustrated and adjustable at point 78. The frequency outside the temperature window, denoted as "when out of range", is illustrated and adjustable at point 79. Such reporting of the recorded data will be otherwise discussed with reference to FIG. 11.

Further considering how a refrigerator opens in accordance with present subject matter, it is understood that the microprocessor processes all of the above information, whether entered manually or by the PC program, and based upon the person's security level and the current state of the temperature monitoring system, the locking system will release.

Figure 7:
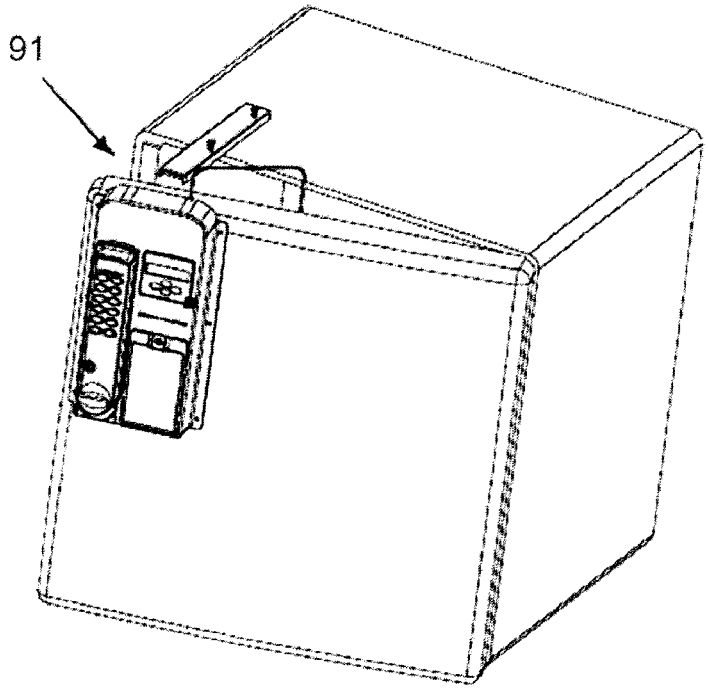
FIG. 7 is an upper right isometric view of a present exemplary refrigerator similar to that as illustrated in FIG. 1 but illustrating the door thereof in an open and unlocked position.
Figure 8A:
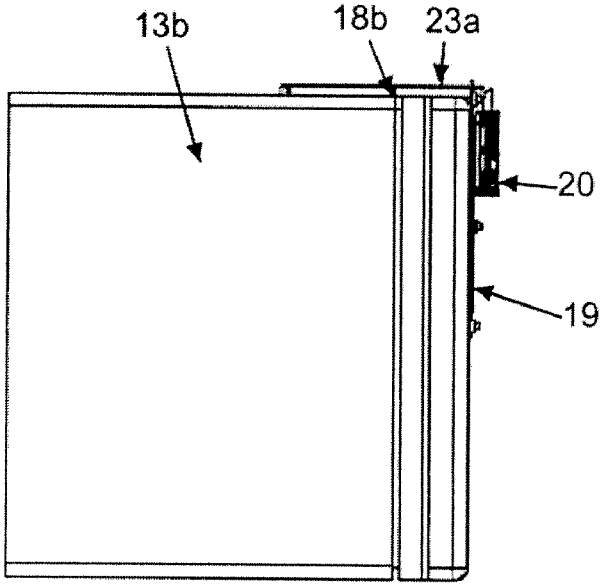
FIG. 8A is a side elevation view of a present exemplary lock on an exemplary refrigerator with the lock bolt thereof hitting a present exemplary strike plate.
Figure 8B:
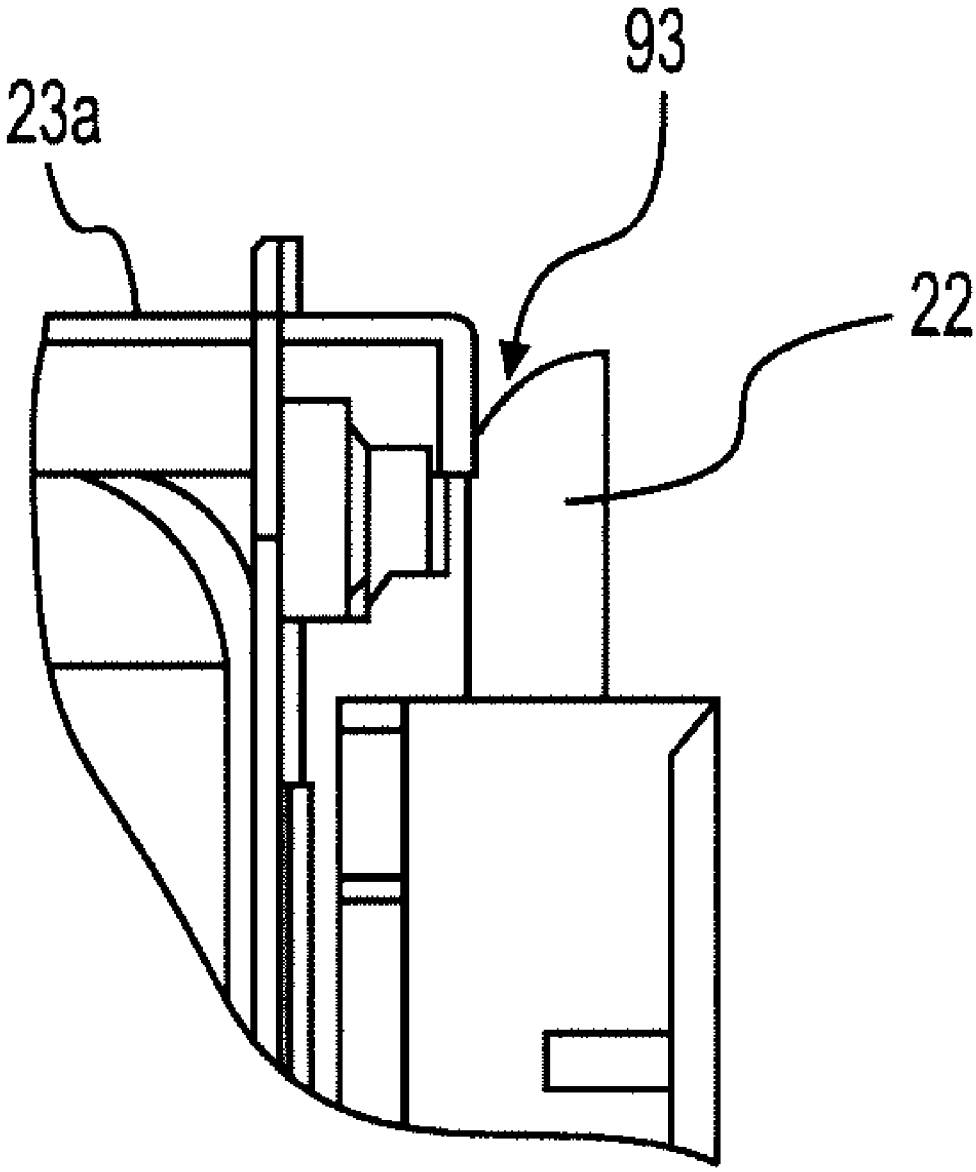
FIG. 8B is an enlarged view of a portion of the exemplary lock illustrated in FIG. 8A, showing in greater detail the present exemplary lock bolt hitting the subject strike plate.

With reference again to FIG. 3, the lock system will now be discussed in the unlocked state. Motor 24 will remain in the un-energized state while the processor times out a pre-programmed open time. Latch bolt 22 will be in the retracted position, which creates gap 90 between latch bolt 22 and strike plate 23*a*. Such gap 90 allows the person who is attempting to gain access to the refrigerator the means to do so. As illustrated now in FIG. 7, the refrigerator is open, as shown by representative gap 91.

In summary, motor 24 is under the control of the microprocessor based circuit within the electronic assembly 14*a*. As shown in FIG. 3, the electronic assembly opens the motorized latch by turning on motor 24. Internal to latch 20 (and not shown for simplicity sake), there is a feedback switch which senses that the latch bolt 22 is fully retracted. When the latch bolt 22 is fully retracted, motor 24 is turned off. The microprocessor keeps the motor turned off for a pre-programmed open time. When such open time timer times out, the processor again energizes motor 24, which releases latch bolt 22. In such state, latch bolt 22 is free to travel in and out of the motorized latch, charging and re-charging the slam bolt return spring.

Figure 9A:
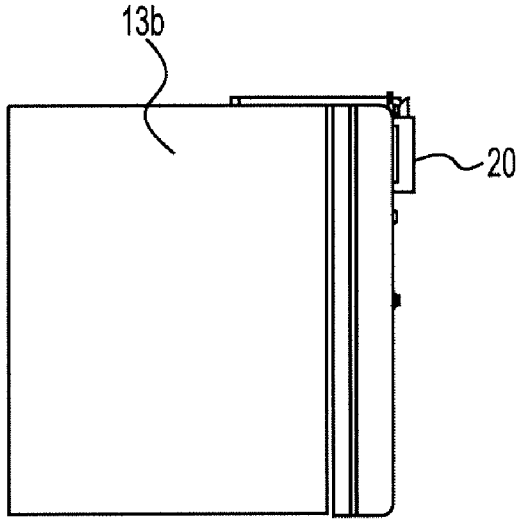
FIG. 9A is a side elevation view of a present exemplary lock on an exemplary refrigerator similar to that as illustrated in FIG. 8A except the exemplary lock bolt has been pressed in by the subject strike plate.
Figure 9B:
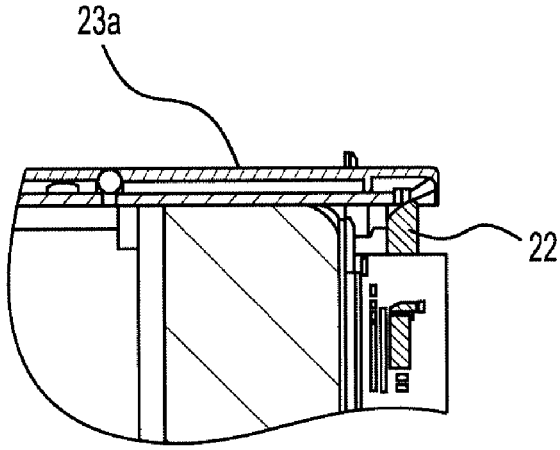
FIG. 9B is an enlarged view of a portion of the exemplary lock illustrated in FIG. 9A, showing in greater detail the present exemplary lock bolt pressed in by the subject strike plate.

Such slam-latch action is needed to automatically lock the refrigerator when the person that gained access to the refrigerator closes the door. Such action is illustrated in FIGS. 8A, 8B, 9A, 9B, 10A, and 10B. First, with reference to FIGS. 8A and 8B, the beginning of the latch relocking action is illustrated. When the refrigerator door is closed, latch bolt 22 comes into contact with strike plate 23*a* at point 93. Such action begins to push latch bolt 22 into the motorized latch 20 and, therefore, begins to charge a slam bolt return spring (not illustrated). The next stage of an exemplary present re-locking event is illustrated in FIGS. 9A and 9B, which show latch bolt 22 further entering motorized latch 20.

Figure 10A:
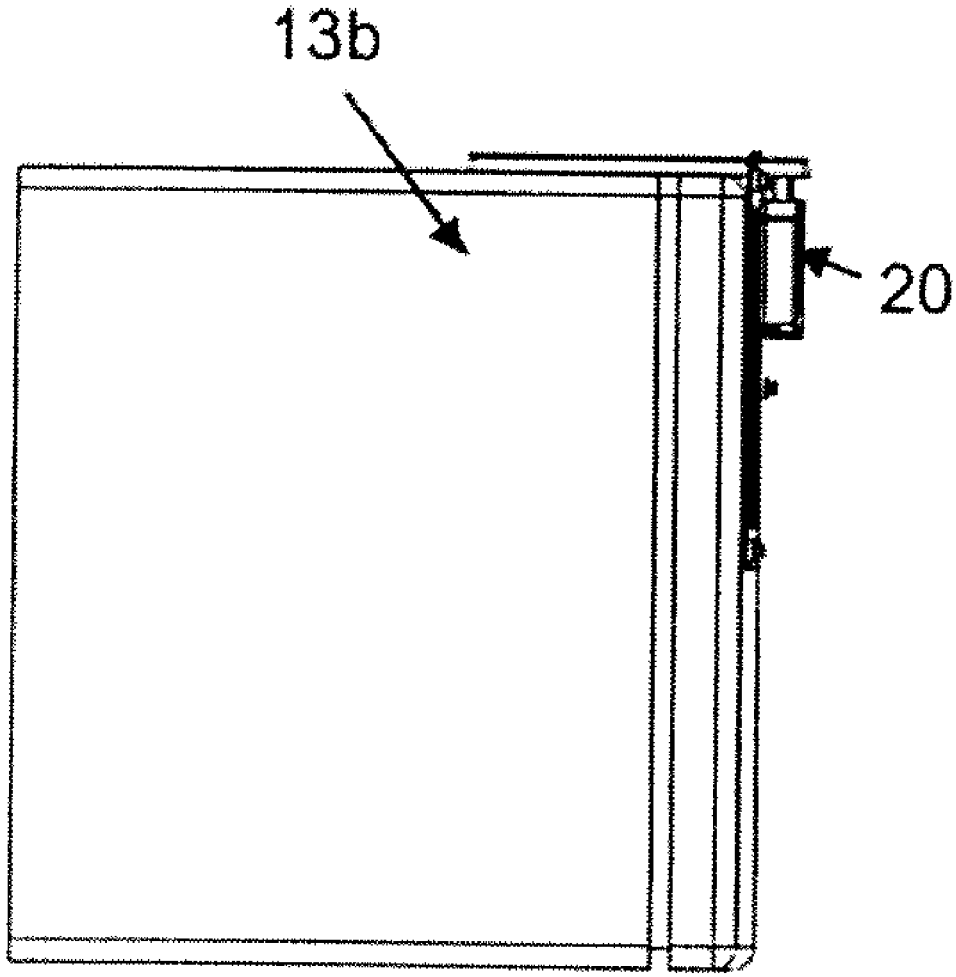
FIG. 10A is a side elevation view of a present exemplary lock on an exemplary refrigerator similar to that as illustrated in FIGS. 8A and 9A except the exemplary lock bolt is engaged in a rectangular cutout of the subject strike plate.
Figure 10B:
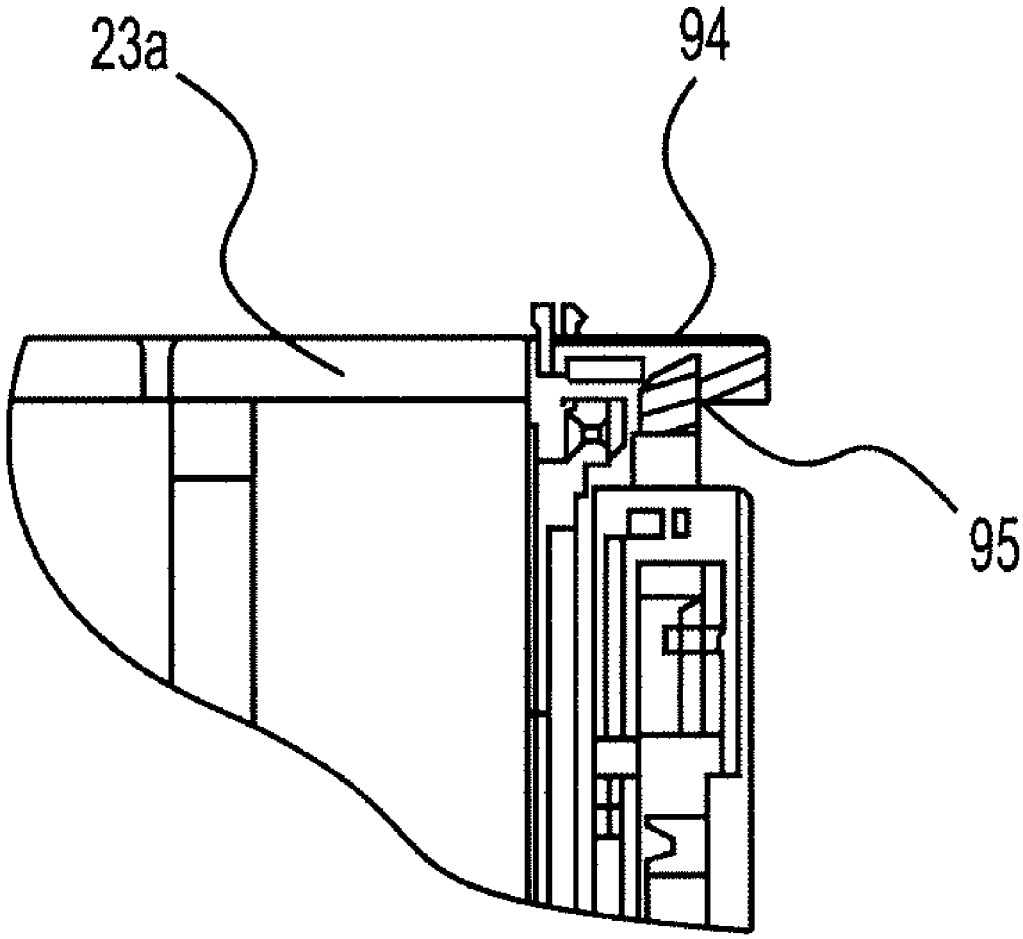
FIG. 10B is an enlarged view of a portion of the exemplary lock illustrated in FIG. 10A, showing in greater detail the present exemplary lock bolt engaged in a rectangular cutout of the subject strike plate.

The final stage of the present exemplary re-locking event is shown in FIGS. 10A and 10B, where the latch bolt 22 enters opening 94 of strike plate 23*a*. The charged slam bolt return spring then causes the latch bolt 22 to extend into strike plate opening 94.

At such time, if someone is attempting to gain unauthorized access to the refrigerator by opening the door, the latch bolt will crash into the front wall of strike plate opening 94 at wall 95. Since the motorized latch 20 is connected to main housing 13*c* with screws 21 and main housing 13*c* is connected to refrigerator door with screws 17, and strike plate 23*a* is secured to the top of the refrigerator with screws, the door of refrigerator 13*b* will not open.

The temperature data that is recorded by the microprocessor at the logging frequencies set at points 78 and 79 can easily be downloaded through communications port 14*c* and displayed as part of the same PC program discussed in FIG. 6. The data can be displayed numerically, that is "38 degrees Celsius at 10:22 am Jun. 22, 2007" or graphically as a plot of temperature vs. time. Sample output from the graphical output screen is shown is FIG. 11.

The operator of the software chooses which temperature based monitoring system to view the corresponding data from in pull down menu 100. The graph is shown in graph area 101, which has time for an X axis. The corresponding X axis values are shown by reference numerals 105 (illustrating the far left time value Jul. 2, 2007 2:24 pm) and 106 (illustrating the far right time value Jul. 3, 2007 2:24 pm). The Y axis in this example is temperature. The temperature values in Celsius are shown on the left side at reference numeral 103 and on the right side in Fahrenheit at reference numeral 104. The actual graph of temperature vs. time in this example is shown by reference numeral 102. The time axis can be moved right (earlier in time) or left (later in time) by control buttons 109*a*, 109*b*, 109*c*, and 109*d*. The size (in time) of the overall window can be changed by pull down 107. For example, it might be advantageous to see temperatures for 3 months on the computer screen or 1 hour, depending on the individual operator needs. The Y axis scale can be selected by pull down 108.

Figure 12:
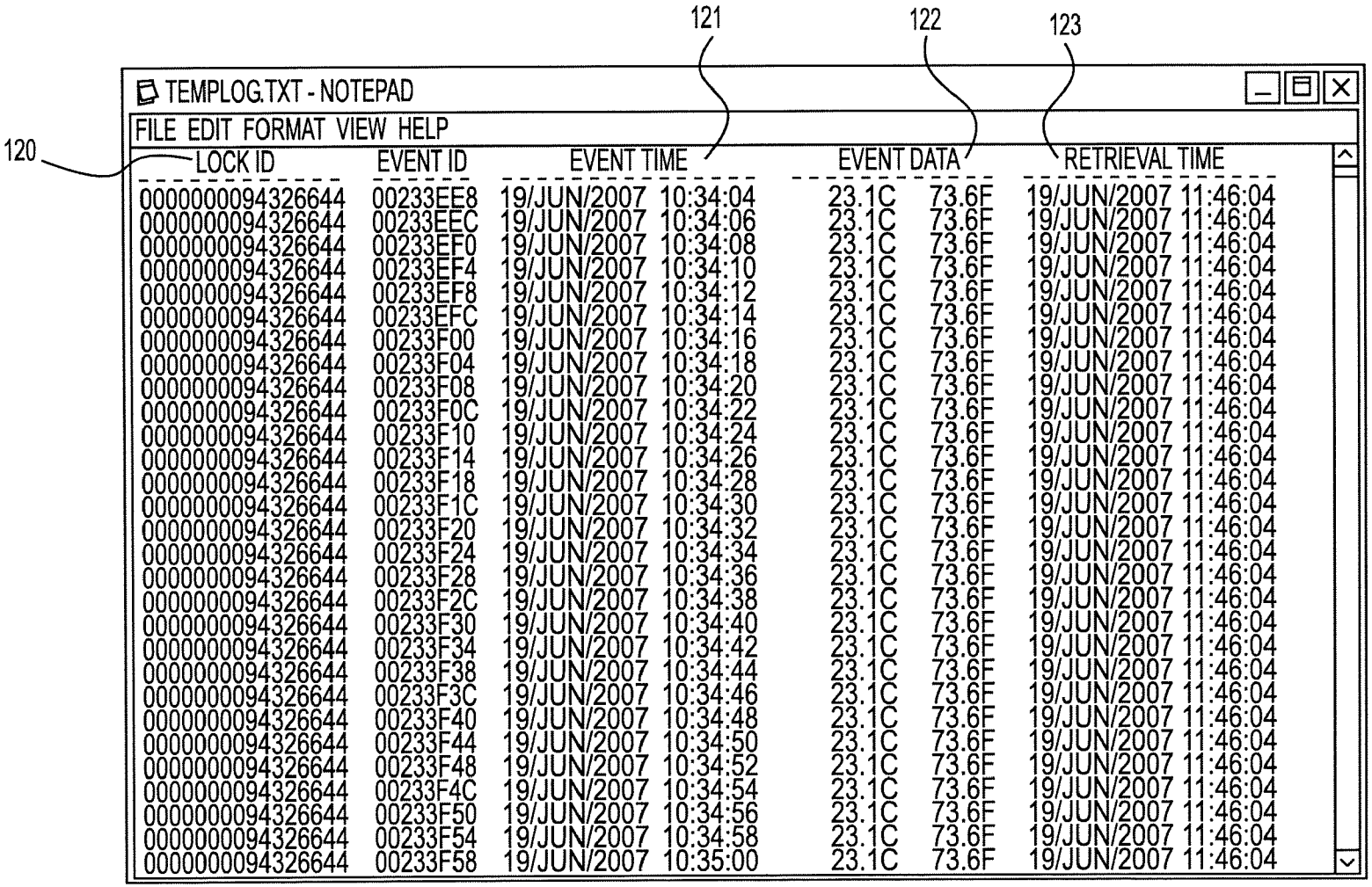
FIG. 12 is an illustration of an exemplary computer generated output of an access data logging feature in accordance with present technology.

Finally, the operator can view the actual temperature and time data in report format by pressing button 110. The output that is created by pushing such button is illustrated in FIG. 12. Column 120 shows the lock serial number, column 121 shows the event time, column 122 shows the recorded temperature, column 123 illustrates the time that the data was retrieved from the lock.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A refrigerated area access control system, comprising:

an access control circuit;

a lock configured to be unlocked by said access control circuit;

a user interface configured to provide user access to said access control circuit; and a temperature transducer coupled to said access control circuit and configured for placement within the refrigerated area;

wherein said access control circuit is configured to monitor the temperature within the refrigerated area and to respectively permit differentiated access to the refrigerated area by a first user having a first access level and a second user having a second access level, such that a first user is denied access to the refrigerated area when the temperature within the refrigerated area is not maintained within predetermined parameters.

2. A refrigerated area access control system as in claim 1, wherein said user interface is further configured to permit said second user to adjust system operational parameters comprising one or more of adding credentials for first users, deleting credentials for first users, and adjusting temperature based parameter settings.

3. A refrigerated area access control system as in claim 2, further comprising a user readable display configured to display values representative of the temperature within the refrigerated area; and wherein said user interface comprises a control panel configured to permit manual programming of operational characteristics of the access control circuit by observation of said user readable display.

4. A refrigerated area access control system as in claim 1, further comprising:

a computer interface associated with said user interface; and a computer; and wherein said computer is configured to permit said second user to adjust system operational parameters comprising one or more of adding credentials for first users, deleting credentials for first users, and adjusting temperature based parameter settings.

5. A refrigerated area access control system as in claim 1, wherein said lock comprises a motorized slam bolt latch.

6. A refrigerated area access control system as in claim 1, further comprising an alarm configured to be activated when the temperature within the refrigerated area is not maintained with said predetermined parameters.

7. A refrigerated area access control system as in claim 1, further comprising:

a memory associated with said access control circuit; and wherein said access control circuit is configured to store in said memory a number of different valid credentials to be used to access said refrigerated area, an audit trail for each access to said refrigerated area, and data logging at predetermined time periods of temperature readings within said refrigerated area.

8. A refrigerated area access control system as in claim 7, further comprising a credential presentation device consisting of at least one of a key pad, an electronic card reader, a biometrics reader, and a computer interface.

9. A refrigerated area access control system as in claim 7, further comprising:

a computer interface associated with said user interface; and a computer; and wherein said computer is configured to upload system operational parameters to said access control circuit and to download and display audit trails and logged temperature data.

10. A refrigerated area access control system as in claim 1, wherein:

said refrigerated area comprises a refrigerator; and said access control system is configured to be retrofittable to said refrigerator.

11. A refrigerated area access control system as in claim 1, further comprising:

a temperature modulator associated with said temperature transducer; and wherein said temperature modulator is configured to provide thermal shock protection for said thermal transducer.

12. A refrigerated area access control system as in claim 1, further comprising:

a temperature modulator associated with said temperature transducer; and wherein said temperature modulator is configured as a thermal shock absorber to allow said thermal transducer to more accurately reflect the temperature of any materials stored in the refrigerated area.

13. A method of providing access to a refrigerated area, comprising:

providing an access control circuit;

monitoring temperature variations within the refrigerated area, for maintenance of such temperature variations within selected predetermined parameters;

providing respectively differentiated access to the refrigerated area to a first user having a first credential enabled access level and to a second user having a second credential enabled access level; and denying access to the refrigerated area by a first user if the temperature within the refrigerated area is not maintained within the selected predetermined parameters.

14. A method as in claim 13, further comprising:

providing a user interface including a display and a control panel; and permitting the second user to add first user credentials, delete first user credentials, and adjust temperature based parameters.

15. A method as in claim 14, further comprising:

providing an alarm signal when the temperature within the refrigerated area is not maintained within the selected predetermined parameters for a predetermined period.

16. A method as in claim 13, wherein providing second user access comprises:

providing a user interface including a computer interface;

associating a memory with the access control circuit;

storing temperature measurement data in the memory; and providing a computer configured to permit the second user to upload data to the memory to add first user credentials, delete first user credentials, and adjust temperature based parameters, and to download and display stored data.

17. A method as in claim 16, further comprising:

monitoring access events by first and second users; and storing an audit trail of the access events in the memory.

18. A method as in claim 13, wherein the step of providing an access control circuit includes retrofitting such access control circuit to an existing refrigerated area.

19. A method as in claim 13, wherein the step of providing an access control circuit includes originally outfitting a refrigerated area with such access control circuit.

* * * * *